United States Patent [19]

Wang et al.

[11] Patent Number: 4,943,693

[45] Date of Patent: Jul. 24, 1990

[54] BARRIER DEVICE FOR AN ELECTRICAL SWITCH

[75] Inventors: David Wang; Chyi-Song Chen, both of Taipei, Taiwan

[73] Assignee: Acer Incorporated, China

[21] Appl. No.: 265,032

[22] Filed: Oct. 31, 1988

[51] Int. Cl.[5] ..... H01H 9/02

[52] U.S. Cl. ..... 200/304; 174/138 F; 439/135

[58] Field of Search ..... 200/304, 305, 297, 296; 174/138 F; 439/135, 149, 521, 892

[56] References Cited

U.S. PATENT DOCUMENTS

| | | | |
|---|---|---|---|
| 2,908,743 | 10/1959 | Premoshis | 200/297 |
| 3,165,574 | 1/1965 | Carling | 439/135 X |
| 4,400,672 | 8/1983 | Bottelson | 200/296 X |
| 4,697,860 | 10/1987 | Hildebrandt et al. | 439/374 |
| 4,774,390 | 9/1988 | Lehman et al. | 200/304 |
| 4,806,112 | 2/1989 | Roberts et al. | 439/135 X |

FOREIGN PATENT DOCUMENTS

| | | | |
|---|---|---|---|
| 0068925 | 1/1983 | European Pat. Off. . | |
| 713597 | 9/1966 | Italy | 174/138 F |
| 2198293 | 6/1988 | United Kingdom . | |

*Primary Examiner*—Renee S. Luebke

*Attorney, Agent, or Firm*—Andrus, Sceales, Starke & Sawall

[57] ABSTRACT

A barrier device (1) which can prevent an electrical switch (10) from shorting in the region of its connecting points (11) includes a rectangular base (20) having an opening (21) therein. A first wall (22) extends upwardly from the first edge of the base (20) a second side wall (23) extends upwardly from the second edge of the base (20), a third side wall (24) extends upwardly from the third edge of the base and a fourth side wall (25) extends upwardly from the fourth edge of the base (20). The first and third side walls (22, 24) have a longer length than the second and fourth side walls (23, 25). A clip member (26) is mounted on the first side wall (22) and can engage the third side wall (24).

6 Claims, 1 Drawing Sheet

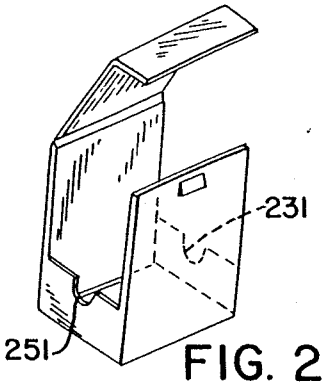
FIG. 2-a
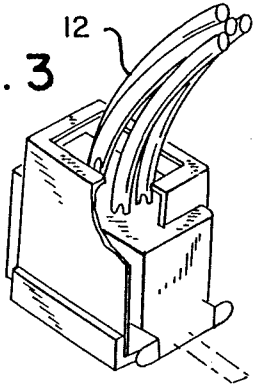
FIG. 3
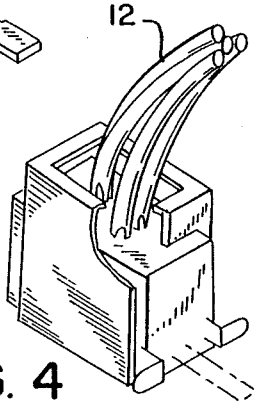
FIG. 4
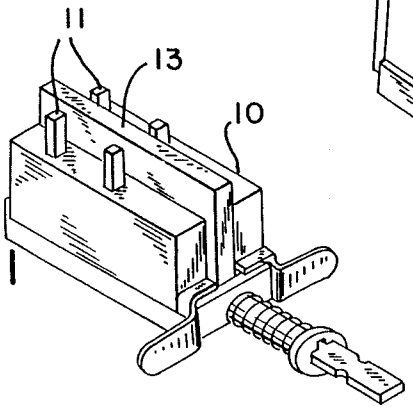
FIG. 1
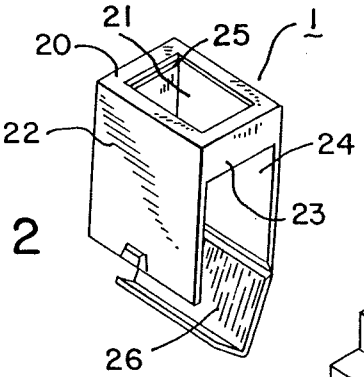
FIG. 2
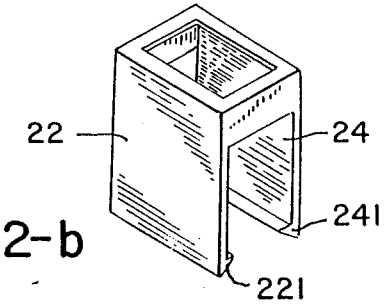
FIG. 2-b

BARRIER DEVICE FOR AN ELECTRICAL SWITCH

The present invention relates generally to the field of electrical switches.

FIG. 1 shows an electrical switch 10 of the type being widely used in the personal computer field for the power "on" and "off" function. The switch 10 has at least four connecting points 11 on its top surface and four electrical wires 12 (FIG. 3) are connected to the connecting points transferring electricity to the computer. There is also an island 13 between those connecting points 11.

Even though the connecting points 11 are spaced apart, there is the possibility of electrical shorting particularly during maintenance when a serviceman's finger or screwdriver may contact the connecting points or due to inadvertent contact with other articles. In the light of this, Underwriter Laboratories (UL) and 20 Technischer Uberwachungs Verein (TUV) require those connecting points 11 to be covered by an insulative material. At the present time, the connecting points 11 are covered by winding insulating tape around them. Of course this kind of method can solve the problem and pass the test of the UL and TUV. But firstly, it takes time in winding the tape. Secondly, it is hard to remove the tape the wire so as to repair the switch 10. Thirdly, it presents a bad appearance as compared with other element in the computer.

In accordance with the present invention a barrier device for an electrical switch having at least one connecting point comprises a rectangular base with an opening through which access to the or each connecting point of the switch can be gained; and first, second, third and fourth side walls depending from respective sides of the base, the arrangement being such that in use the or each connecting point is protected by the barrier device.

The present invention provides a barrier device which can be easily mounted on the switch and can be removed quickly so as to repair the switch while providing a much better appearance.

Some examples of barrier devices according to the invention will now be described with reference to the accompanying drawings, in which:

FIG. 1 is a perspective view of an electrical switch;

FIG. 2 is a perspective view of a first embodiment of the device;

FIG. 2*a* is a perspective view of a second embodiment of the device;

FIG. 2*b* is a perspective view of a third embodiment of the device;

FIG. 3 is a perspective view showing the first embodiment mounted on the electrical switch; and, FIG. 4 is a perspective view showing the third embodiment mounted on the electrical switch.

The barrier device shown in FIG. 2 includes a base 20 having an opening 21 in the middle of the base 20, through which wires coupled to a switch can pass. A first side wall 22 extends downwardly from a first edge of the base, a second side wall 23 extends downwardly from a second edge of the base, a third wall 24 extends downwardly from a third edge of the base and a fourth side wall 25 extends downwardly from a fourth edge of the base. The lengths of the first side wall 22 and third side wall 24 are longer than those of the second side wall 23 and fourth side wall 25. A clip member 36 is pivotally mounted on the lower edge of the third side wall 24 and can bridge to the first side wall 22 when swung upwardly when the barrier device is oriented as shown in FIG. 2.

In order to conform with different types of switches, the second side of wall 23 and fourth side wall 25 may have notches 231, 251 thereon (FIG. 2*a*). This second embodiment is suitable for use together with the switch shown in FIG. 1, where an island 13 is formed between the connecting points 11.

FIG. 2*b* illustrates a third embodiment in which the first side wall 22 and the third side wall 24 each have a projection 221, 241 on their tips to clip around the switch device 10 which can be easily wrapped by the barrier device 1.

FIG. 3 shows the first embodiment of the barrier device 1 mounted on the electrical switch 10 and FIG. 4 illustrates the electrical switch 10 wrapped by the third embodiment of the device 1. In each case it will be seen that the connecting points 11 are set below the opening 21 thus protecting them against inadvertently short circuiting and avoiding the need for winding tape.

We claim:

1. A barrier device for an electrical switch, the electrical switch having at least one connecting point, said barrier device having: a rectangular base with an opening through which access to the or each connecting point of the switch can be gained; first, second, third, and fourth side walls depending from respective sides of said base, each of said side walls having an upper edge joined to said base and a lower edge, each of said side walls lying in a single plane generally normal to said base, said first and third side walls mutually opposing each other, said second and fourth side walls mutually opposing each other, said first and third side walls being longer than said second and fourth side walls and defining a slot for receiving the switch between said first and third side walls; and a clip member pivotally connected to the lower edge of said third side wall for movement into engagement with said first side wall so as to span the slot between said first and third side walls for preventing the removal of the switch from the slot in a direction normal to said base, said clip member having means for retaining said member in engagement with said first side wall.

2. A barrier device according to claim 1 wherein said clip member comprises a bottom wall of said barrier device lying parallel to said base when said clip member is in engagement with said first side wall.

3. A barrier device according to claim 1 wherein said second and fourth side walls each have a notch in the lower edge thereof for accommodating an island of the electrical switch.

4. A switch assembly comprising an electrical switch having at least one connecting point and a barrier device mounted on said switch, said barrier device having: a rectangular base with an opening through which access to the or each connecting point of the switch can be gained; first, second, third, and fourth side walls depending from respective sides of said base, each of said side walls having an upper edge joined to said base and a lower edge, each of said side walls lying in a single plane generally normal to said base, said first and third side walls mutually opposing each other, said second and fourth side walls mutually opposing each other, said first and third side walls being longer than said second and fourth side walls and defining a slot for receiving the switch between said first and third side walls; and a clip member pivotally connected to the lower edge of said third side wall for movement into engagement with said first side wall so as to span the slot between said first and third side walls for preventing the removal of the switch from the slot in a direction normal to said base, said clip member having means for retaining said member in engagement with said first side wall.

5. A switch assembly according to claim 4 wherein said clip member comprises a bottom wall of said barrier device lying parallel to said base when said clip member is in engagement with said first side wall.

6. A switch assembly according to claim 4 wherein said second and fourth side walls each have a notch in the lower edge thereof for accommodating an island of the electrical switch.

* * * * *